US012077902B2

(12) United States Patent
Kim et al.

(10) Patent No.: US 12,077,902 B2
(45) Date of Patent: Sep. 3, 2024

(54) GARMENT FOLDING APPARATUS

(71) Applicant: LG Electronics Inc., Seoul (KR)

(72) Inventors: Keunjoo Kim, Seoul (KR); Jeongyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 157 days.

(21) Appl. No.: 17/784,479

(22) PCT Filed: Dec. 8, 2020

(86) PCT No.: PCT/KR2020/017812
§ 371 (c)(1),
(2) Date: Jun. 10, 2022

(87) PCT Pub. No.: WO2021/118195
PCT Pub. Date: Jun. 17, 2021

(65) Prior Publication Data

US 2023/0036912 A1 Feb. 2, 2023

(30) Foreign Application Priority Data

Dec. 11, 2019 (KR) ..... 10-2019-0164585

(51) Int. Cl.
*D06F 89/02* (2006.01)
*D06F 89/00* (2006.01)

(52) U.S. Cl.
CPC ..... *D06F 89/02* (2013.01); *D06F 89/00* (2013.01)

(58) Field of Classification Search
CPC ..... D06F 89/00; D06F 89/02; D06F 89/023; D06F 89/026
(Continued)

(56) References Cited

U.S. PATENT DOCUMENTS 2,887,313 A * 5/1959 Malott, Jr. ..... D06F 89/00 493/23
3,514,020 A * 5/1970 Lornitzo ..... D06F 89/026 223/52.1
(Continued)

FOREIGN PATENT DOCUMENTS

CN 204875295 12/2015
CN 107338636 11/2017
(Continued)

OTHER PUBLICATIONS

International Search Report in International Appln. No. PCT/KR2020/017812, dated Mar. 12, 2021, 5 pages (with English translation).
(Continued)

*Primary Examiner* — Shaun R Hurley
(74) *Attorney, Agent, or Firm* — Fish & Richardson P.C.

(57) ABSTRACT

The present disclosure relates to a garment folding apparatus, which serves to fold a garment during a process of conveying the garment, the garment folding apparatus including a loading assembly configured to load the garment, a folding assembly configured to fold the loaded garment while conveying the garment, and an unloading assembly disposed below the folding assembly and configured to unload a completely folded garment, in which the folding assembly comprises a vertical folding assembly configured to actively fold the garment deployed on a conveyor by using a drive motor, such that a vertical folding operation is performed along a rectilinear trajectory, which makes it possible to reduce a required operation space and contribute to miniaturization of the apparatus.

12 Claims, 14 Drawing Sheets

(58) Field of Classification Search
USPC ..... 223/37
See application file for complete search history.

(56) References Cited

U.S. PATENT DOCUMENTS

| | | | | | |
|---|---|---|---|---|---|
| 4,093,205 | A * | 6/1978 | Kober | B65H 45/04 493/425 |
| 4,248,414 | A * | 2/1981 | Rovin | B65H 45/04 242/532.6 |
| 4,548,595 | A * | 10/1985 | Heater | B65H 45/04 493/458 |
| 5,300,007 | A * | 4/1994 | Kober | D06F 89/00 493/450 |
| 5,435,802 | A * | 7/1995 | Kober | D06F 89/00 493/450 |
| 2022/0396913 | A1* | 12/2022 | Kim | D06F 89/00 |

FOREIGN PATENT DOCUMENTS

| | | | | |
|---|---|---|---|---|
| CN | 107815839 | | 3/2018 | |
| CN | 109629215 | | 4/2019 | |
| CN | 110029482 | | 7/2019 | |
| CN | 110629497 | A * | 12/2019 | D06F 89/02 |
| JP | H01-310700 | | 12/1989 | |
| JP | 2000202200 | | 7/2000 | |
| KR | 200309150 | | 3/2003 | |
| KR | 200465910 | | 3/2013 | |

OTHER PUBLICATIONS

Extended European Search Report in European Appln. No. 20898836.0, mailed on Nov. 16, 2023, 8 pages.

* cited by examiner

GARMENT FOLDING APPARATUS

CROSS-REFERENCE TO RELATED APPLICATIONS

This application is a National Stage application under 35 U.S.C. § 371 of International Application No. PCT/KR2020/017812, filed on Dec. 8, 2020, which claims the benefit of Korean Application No. 10-2019-0164585, filed on Dec. 11, 2019. The disclosures of the prior applications are incorporated by reference in their entirety.

TECHNICAL FIELD

The present disclosure relates to an automated apparatus for folding a garment.

BACKGROUND ART

Garments are made of soft materials such as natural fibers or synthetic fibers and need to be folded to appropriate sizes and shapes so that the garments are stored and carried.

Usually, it is necessary to perform a process of folding the garments significantly often or perform a process of folding a large quantity of garments in order to accommodate the garments after washing the garments or to store the garments for a long period of time in accordance with a change in season. However, a process of manually and directly folding the garments causes a waste of time and resources. In a case in which the garments are folded by unskilled persons, the shapes and the sizes of the folded garments are not uniform, which causes a problem in that additional labor is required to fold the garments for the purpose of displaying or storing the garments.

Therefore, there is a gradually increasing need for an automated apparatus (hereinafter, referred to as a 'garment folding apparatus') capable of quickly and uniformly performing a process of folding garments. PCT International Patent Application Laid-Open No. 2018-122841 (entitled DOMESTIC COMPACT ARTICLE FOLDING MACHINE HAVING STACKED CONVEYOR LAYERS AND FOLDING METHOD THEREFOR) (hereinafter, referred to as the 'related art document') has been published on Jul. 5, 2018, in respect to the garment folding apparatus in the related art. The related art document discloses a technology related to an automated apparatus in which a garment is loaded into an upper side of the automated apparatus, folded, and unloaded from a lower side of the automated apparatus.

However, the following problems occur when a vertical folding assembly of the apparatus disclosed in the related art document folds a garment.

First, when plates positioned at left and right sides move to perform a folding process by being operated by a rotary link, the plates move along a circular or curved movement trajectory. For this reason, there are problems in that the upper and lateral portions of the vertical folding assembly require a significantly large operating space, and overall intervals or widths between the vertical folding assembly and other folding layers are increased, which hinders the miniaturization of the apparatus.

In addition, in a case in which a garment, which is a folding target, is entirely thick, a material of the garment is stiff, or the left and right widths of the garment, such as children's clothes, are not large, the garment is not appropriately folded or the garment is trapped because of the circular or curved trajectory of the plate of the apparatus disclosed in the related art document. For this reason, there is a problem in that the folding quality significantly deteriorates.

DISCLOSURE

Technical Problem

The present disclosure has been made in an effort to provide a garment folding apparatus, in which a plate operates along a rectilinear trajectory instead of a circular or curved trajectory in order to solve a problem of an increase in operation space or deterioration in folding quality that occurs in a garment folding apparatus in the related art.

Technical Solution

To achieve the above-mentioned object, an embodiment of the present disclosure provides a garment folding apparatus, which serves to fold a garment during a process of conveying the garment, the garment folding apparatus including: a loading assembly configured to load the garment; a folding assembly configured to fold the loaded garment while conveying the garment; and an unloading assembly disposed below the folding assembly and configured to unload a completely folded garment, in which the folding assembly includes a vertical folding assembly configured to actively fold the garment deployed on a conveyor by using a drive motor, and in which the vertical folding assembly includes: plates disposed side by side on the conveyor and configured to move to an inner upper side of the conveyor during a folding operation; and cam units having guide grooves so that the plates slide along rectilinear trajectories when the plates operate.

Insertion parts connected to the plates may be inserted into the guide grooves so that the plates move along the trajectories defined by the guide grooves.

In addition, according to the embodiment of the present disclosure, the guide groove may be inclined toward the inner upper side from the outside.

In addition, according to the embodiment of the present disclosure, the cam unit may have first and second guide grooves formed side by side.

In addition, according to the embodiment of the present disclosure, the first and second guide grooves may have different slide shapes.

In addition, according to the embodiment of the present disclosure, the guide groove may include a horizontal groove configured to allow the plate to initially operate along a horizontal trajectory; and an inclined groove connected to the horizontal groove and configured to allow the plate to have an inclined trajectory.

In addition, according to the embodiment of the present disclosure, a plate hinge may be provided between the plate and the insertion part.

In addition, according to the embodiment of the present disclosure, the vertical folding assembly may include: a lower housing configured to accommodate the cam unit; and a bottom structure provided in the lower housing and configured to implement the motion of the plate.

In addition, according to the embodiment of the present disclosure, the bottom structure may include: rotary links configured to receive a rotational force from the drive motor and rotate about a central axis; and a connecting link configured to convert a rotational motion of the rotary link into a rectilinear motion.

In addition, according to the embodiment of the present disclosure, the rotary links may be spaced apart from each other in an upward/downward direction and disposed symmetrically with respect to the lower housing.

In addition, according to the embodiment of the present disclosure, the bottom structure may further include a slider having one end connected to the connecting link and the other end connected to the insertion part.

In addition, according to the embodiment of the present disclosure, the rotary link, the connecting link, and the slider may be hingedly coupled to one another.

Advantageous Effect

According to at least one of the embodiments of the present disclosure, the plate for performing the vertical folding process may move along the rectilinear trajectory, such that a required operation space is reduced, which may contribute to the miniaturization of the apparatus.

In addition, according to at least one of the embodiments of the present disclosure, the accurate vertical folding process may be performed without being affected by the material and size of the garment, which makes it possible to treat various garments and ensure uniform and improved folding quality in comparison with the related art.

An additional range of the applicability of the present disclosure will become apparent from the following detailed description. However, various alterations and modifications may be clearly understood by those skilled in the art without departing from the spirit and scope of the present disclosure. Accordingly, it should be understood that the detailed description and the specific embodiments such as the exemplary embodiments of the present disclosure are just provided for illustrative purposes.

MODE FOR INVENTION

Figure 1:
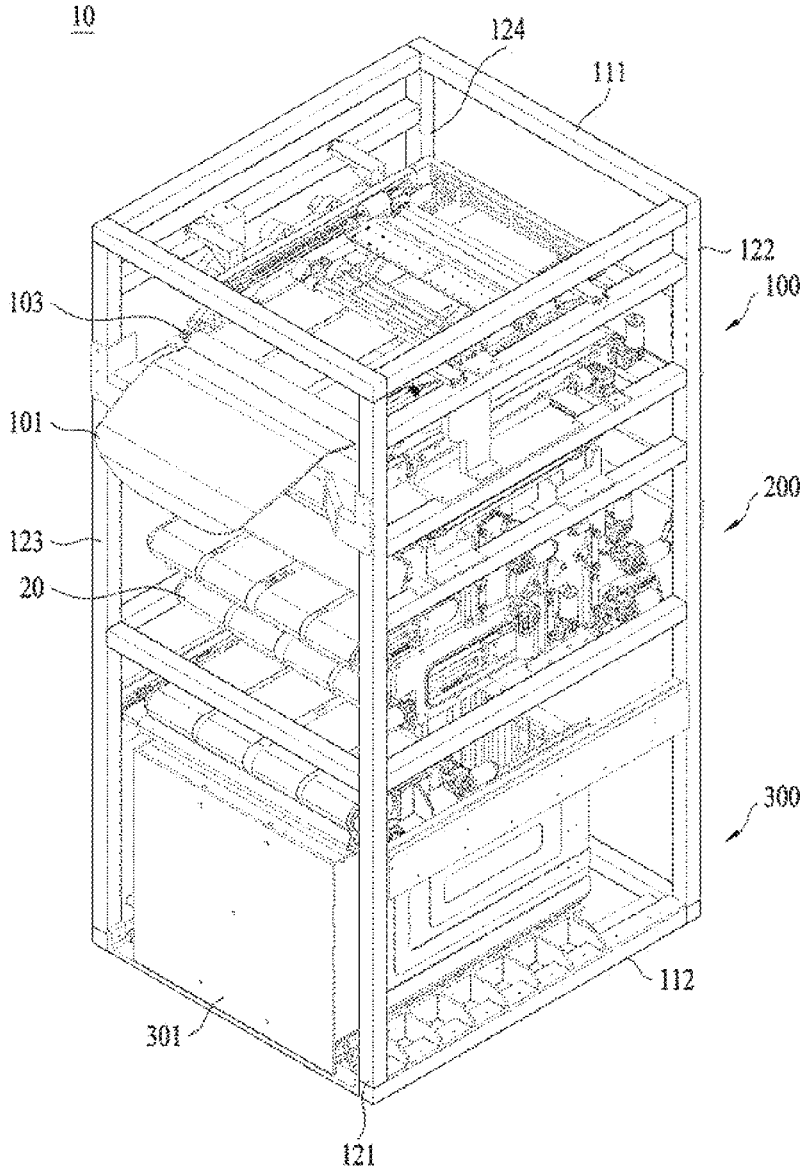
FIG. 1 is a perspective view of a garment folding apparatus according to an embodiment of the present disclosure.

Hereinafter, embodiments disclosed in the present specification will be described in detail with reference to the accompanying drawings. The same or similar constituent elements are assigned with the same reference numerals regardless of reference numerals, and the repetitive description thereof will be omitted. The suffixes 'assembly', 'unit', 'part', and 'portion' used to describe constituent elements in the following description are used together or interchangeably in order to facilitate the description, but the suffixes themselves do not have distinguishable meanings or functions. In addition, in the description of the embodiment disclosed in the present specification, the specific descriptions of publicly known related technologies will be omitted when it is determined that the specific descriptions may obscure the subject matter of the embodiment disclosed in the present specification. In addition, it should be interpreted that the accompanying drawings are provided only to allow those skilled in the art to easily understand the embodiments disclosed in the present specification, and the technical spirit disclosed in the present specification is not limited by the accompanying drawings, and includes all alterations, equivalents, and alternatives that are included in the spirit and the technical scope of the present disclosure.

The terms including ordinal numbers such as 'first', 'second', and the like may be used to describe various constituent elements, but the constituent elements are not limited by the terms. These terms are used only to distinguish one constituent element from another constituent element.

When one constituent element is described as being "coupled" or "connected" to another constituent element, it should be understood that one constituent element can be coupled or connected directly to another constituent element, and an intervening constituent element can also be present between the constituent elements. When one constituent element is described as being "coupled directly to" or "connected directly to" another constituent element, it should be understood that no intervening constituent element is present between the constituent elements.

Singular expressions include plural expressions unless clearly described as different meanings in the context.

In the present application, it will be appreciated that terms "including" and "having" are intended to designate the existence of characteristics, numbers, steps, operations, constituent elements, and components described in the specification or a combination thereof, and do not exclude a possibility of the existence or addition of one or more other characteristics, numbers, steps, operations, constituent elements, and components, or a combination thereof in advance.

Hereinafter, a garment folding apparatus 10 according to the present disclosure will be described with reference to a description with reference to FIGS. 1 to 3. FIG. 1 is a perspective view of a garment folding apparatus according to an embodiment of the present disclosure, FIG. 2 is a side view of the garment folding apparatus in FIG. 1, and FIG. 3 is a side view illustrating a configuration of a folding assembly according to the embodiment of the present disclosure.

Figure 2:
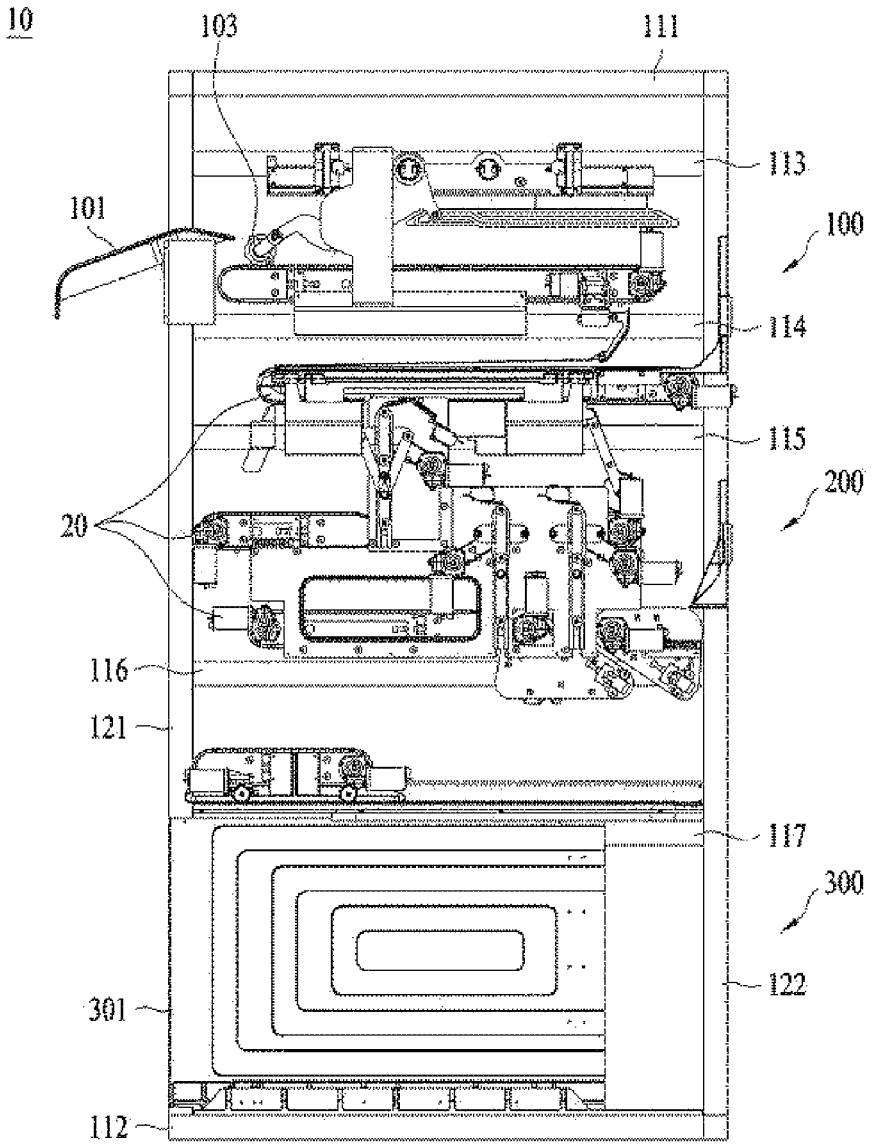
FIG. 2 is a side view of the garment folding apparatus in FIG. 1.
Figure 3:
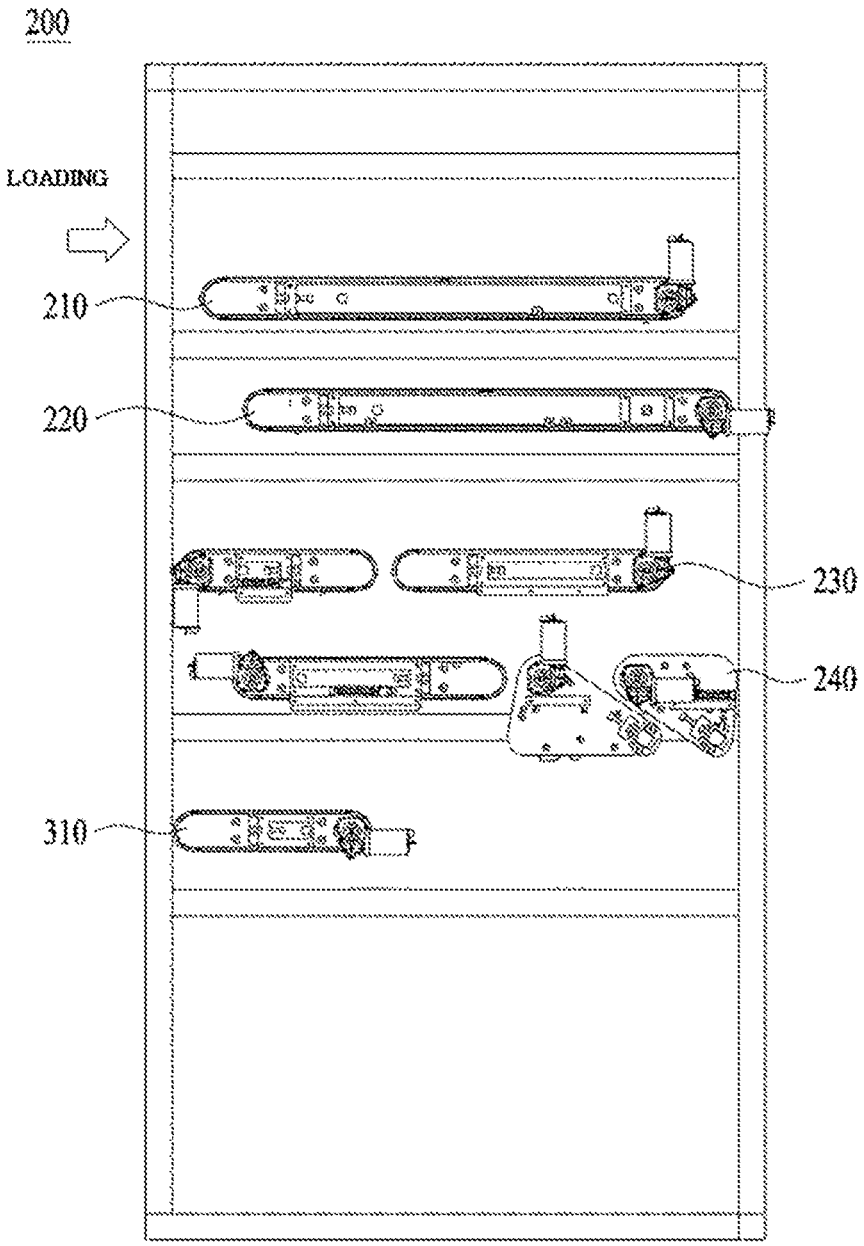
FIG. 3 is a side view illustrating a configuration of a folding assembly according to the embodiment of the present disclosure.

Referring to FIGS. 1 and 2, the garment folding apparatus 10 according to the present disclosure may be supported and installed on a frame 110. The frame may serve as an external framework of the garment folding apparatus 10. The frame may be disposed on an outer edge of the garment folding apparatus 10 and define a minimum operating space for the garment folding apparatus 10. Several members constituting the garment folding apparatus 10 may be stably attached to and supported on the frame.

The frame includes an upper frame 111, a lower frame 112, and horizontal frames 113, 114, 115, 116, and 117. The frame includes vertical frames 121, 122, 123, and 124 (see FIG. 1) disposed vertically and configured to support the upper frame 111, the lower frame 112, and the horizontal frames.

A finishing cover (not illustrated) may be stably attached to an outer peripheral surface of the frame. The finishing cover may define an external appearance of the garment folding apparatus.

Since the frame is provided as described above, a vertical folding assembly to be described below may be stably supported and mounted to smoothly perform a garment folding function.

Referring to FIGS. 1 and 2, the garment folding apparatus 10 includes a loading assembly 100, a folding assembly 200, and an unloading assembly 300.

The loading assembly 100, the folding assembly 200, and the unloading assembly 300 may be supported on the frame. In addition, the loading assembly 100, the folding assembly 200, and the unloading assembly 300 may have operating spaces defined by the frame.

For example, an operating space of the loading assembly 100 may be defined by the upper frame 111 and the horizontal frame 114, and an operating space of the unloading assembly 300 may be defined by the horizontal frame 116 and the lower frame 112.

The loading assembly 100 is provided to load the garment. The loading assembly 100 may be provided such that the garment loaded onto the loading unit 101 may be placed on an upper surface of the conveyor 20. Specifically, the loading assembly 100 may be provided between the upper frame 111 and the horizontal frame 114 so that the garment loaded onto the loading unit 101 may be placed on the upper surface of the conveyor 20.

In this case, the garments not only mean upper garments or lower garments manufactured using natural fibers or synthetic fibers so as to be worn by persons, but also include all products such as towels or bedclothes that may be provided by being folded to have desired sizes and thicknesses by the garment folding apparatus.

In one embodiment, in the loading assembly 100, the garment loaded by the loading unit 101 is held by a clip unit 103 (see FIGS. 1 and 2). Thereafter, the clip unit 103 pulls the garment rearward by a predetermined distance and releases the garment so that the garment is placed on the upper surface of the conveyor 20. The conveyor 20 may be supported by the horizontal frame 114, and the clip unit 103 may be supported by the horizontal frame 113 horizontally disposed between the upper frame 111 and the horizontal frame 114.

The unloading assembly 300 serve to collect and unload the folded garments. The unloading assembly 300 may be configured such that the completely folded garments are conveyed from an unloading layer 310 (see FIG. 3) by the support conveyor and collected on an unloading unit 301. Specifically, the unloading assembly 300 may be provided between the horizontal frame 116 and the lower frame 112 so that the completely folded garments are conveyed by the support conveyor and collected on the unloading unit 301.

In one embodiment, the garment dropped by the folding assembly is placed on the support conveyor. Thereafter, the support conveyor moves in the forward/rearward direction, and at the same time, an unloading plate (not illustrated) moves in the upward/downward direction, such that the completely folded garments are uniformly collected in an internal space of the unloading unit 301. A guide rail configured to guide and support the movement of the support conveyor may be supported by the horizontal frame 117 horizontally disposed between the horizontal frame 116 and the lower frame 112. The vertical movement of the unloading plate of the vertical folding assembly may be supported by the lower frame 112.

The folding assembly 200 serve to convey and fold the loaded garment. The folding assembly 200 includes the two or more folding layers so that the loaded garment is folded to an appropriate size and shape. The two or more folding layers are disposed to be vertically spaced apart from each other. The loaded garment is folded one or more times in the respective folding layers while being conveyed from the folding layer at the upper side to the folding layer at the lower side, and the garments, which are completely folded to appropriate sizes and shapes, are collected in an unloading unit 301.

In the embodiment illustrated in FIG. 3, the folding assembly 200 may include four folding layers 210, 220, 230, and 240. The four folding layers 210, 220, 230, and 240 may be disposed to be vertically spaced apart from each other and serve to allow the loaded garment to be folded to an appropriate size and shape while being conveyed from the first folding layer 210 at the upper side to the fourth folding layer 240 at the lower side. The garment is folded one or more times in each of the folding layers. For example, the garment may be folded twice in the fourth folding layer 240.

The unloading layer 310 may be disposed below the lowermost folding layer. In the embodiment illustrated in FIG. 3, the unloading layer 310 may be further provided below the fourth folding layer 240, and the completely folded garment is dropped onto the unloading layer 310. As described above, the unloading layer 310 has the unloading unit 301 on which the completely folded garments are uniformly collected.

The folding layer includes the conveyor 20. The conveyor 20 serves to horizontally convey the loaded or dropped garment. The folding layers each have one or more conveyors 20. In a case in which the single folding layer has the two or more conveyors, a folding gap through which the garment is folded or passes while being folded is provided between the two conveyors.

In the embodiment illustrated in FIG. 3, the four folding layers 210, 220, 230, and 240 may each have one or more conveyors 20. The third folding layer 230 may have the two conveyors 20, and the fourth folding layer 240 may have the three conveyors 20. A folding gap through which the garment may pass while being folded may be formed between the two conveyors disposed in the third folding layer 230. Two folding gaps through which the garment may be folded or pass while being folded may be formed between the three conveyors provided in the fourth folding layer 240.

The support conveyor may be provided to be horizontally movable in the unloading layer 310. As described above, the support conveyor, together with the unloading plate (not illustrated), serves to uniformly collect the completely folded garments on the unloading unit 301.

Meanwhile, the folding assembly 200 may be configured such that the loaded garment is vertically folded while being conveyed, and the loaded or dropped garments is horizontally folded while being conveyed.

In the embodiment illustrated in FIG. 3, among the four folding layers constituting the folding assembly 200, the garment may be vertically folded in the two folding layers 210 and 220 (hereinafter, referred to as 'vertical folding layers') at the upper side, and the garment may be horizontally folded in the two folding layers 230 and 240 (hereinafter, referred to as 'horizontal folding layers') at the lower side.

In this case, the horizontal folding means that the garment is folded about a reference line perpendicular to a proceeding direction of the garment. The direction perpendicular to the proceeding direction of the garment is not limited to a configuration in which a line in the proceeding direction of the garment and a folding line are perfectly disposed at 90 degrees, but the direction perpendicular to the proceeding direction of the garment includes a configuration in which the line in the proceeding direction of the garment and the folding line are disposed within an error range of 0 degree to 30 degrees.

In this case, the vertical folding means that the garment is folded about a reference line parallel to the proceeding direction of the garment. The direction parallel to the proceeding direction of the garment is not limited to a configuration in which the line in the proceeding direction of the garment and the folding line are perfectly disposed at 0 degree, but the direction parallel to the proceeding direction of the garment includes a configuration in which the line in the proceeding direction of the garment and the folding line are disposed within an error range of 0 degree to 30 degrees.

Hereinafter, the structures and functions of the vertical folding layer and the vertical folding assembly included in the vertical folding layer will be described in detail.

Figure 4:
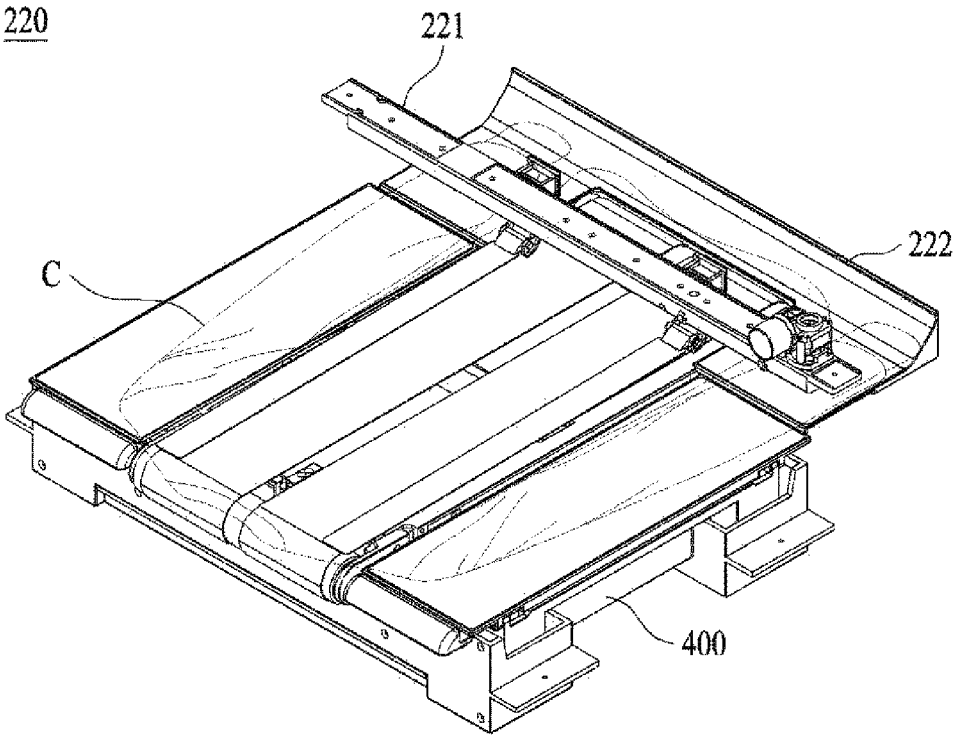
FIG. 4 is a perspective view illustrating an operation according to the embodiment of the present disclosure before a vertical folding process is performed.
Figure 5:
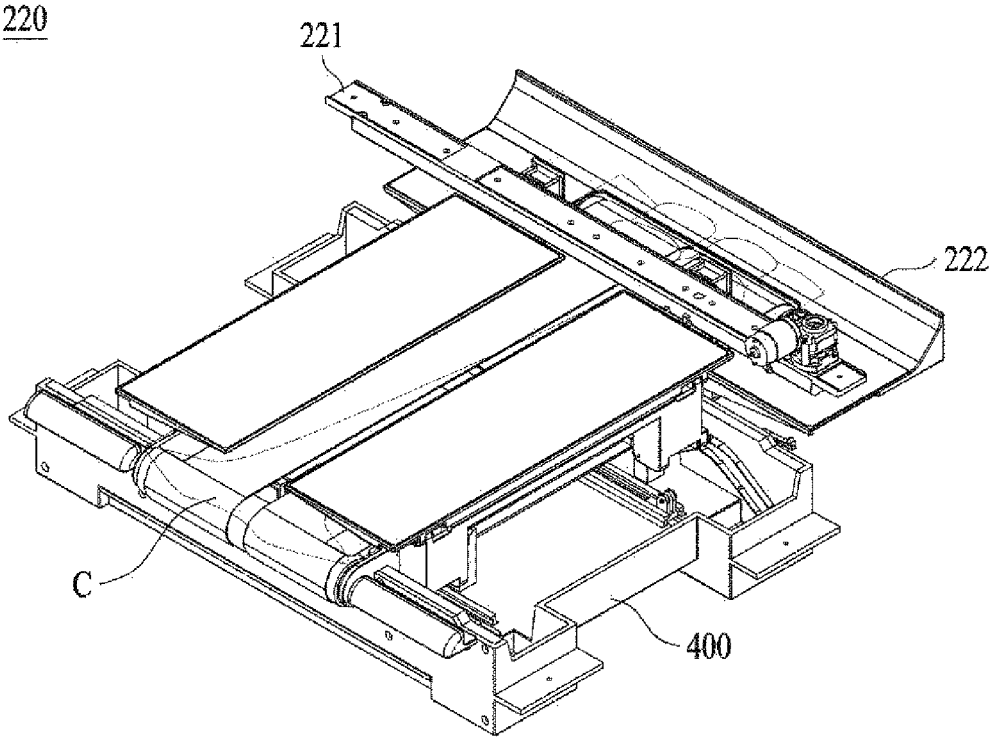
FIG. 5 is a perspective view illustrating an operation according to the embodiment of the present disclosure after the vertical folding process is performed.

FIG. 4 is a perspective view illustrating an operation according to the embodiment of the present disclosure before a vertical folding process is performed, and FIG. 5 is a perspective view illustrating an operation according to the embodiment of the present disclosure after the vertical folding process is performed.

The folding assembly 200 includes the vertical folding layers configured to vertically fold the loaded garment. The vertical folding layers may include the first folding layer 210 and/or the second folding layer 220.

The vertical folding layer includes a vertical folding assembly 400. The vertical folding assembly 400 may be provided in the first folding layer 210 and/or the second folding layer 220.

Hereinafter, with reference to FIGS. 4 to 5, the embodiment will be described, in which the vertical folding layers include the first folding layer 210 and the second folding layer 220, and the vertical folding assembly 400 is provided in the second folding layer 220.

The second folding layer 220 may be provided below the first folding layer 210. The second folding layer 220 may be configured to vertically fold the garment loaded from the first folding layer 210 while conveying the garment forward.

The garment loaded from the loading assembly 100 may be subjected to the intended vertical folding process while passing through the vertical folding layer including the first folding layer 210 and the second folding layer 220. In other words, the folding assembly 200 may have the vertical folding layer that serves to vertically fold the loaded garment to an intended size and shape.

The vertical folding layer may have a vertical folding guide unit 221. In the embodiment illustrated in FIG. 4, the vertical folding guide unit 221 may be mounted on the conveyor 20 of the first folding layer 210. The vertical folding guide unit 221 may be supported on a lower portion of the conveyor 20 of the first folding layer 210 and stably guide the garment C conveyed forward from the second folding layer 220 by pushing the garment C downward. The outer portion of the garment C guided by the vertical folding guide unit 221 is folded inward by a vertical folding assembly 400.

In the embodiment illustrated in FIG. 4, the vertical folding guide unit 221 may be mounted on the upper conveyor and stably guide the garment loaded onto the lower conveyor by pushing the garment downward. The guide frame of the vertical folding guide unit 221 may be mounted on the upper conveyor and support the guide blade in order to guide the garment loaded onto the upper surface of the lower conveyor. To more stably guide the garment, the guide blade may be inclined downward in the forward direction from the upper surface of the lower conveyor.

The position of the guide blade may be changed in the width direction relative to the guide frame. Therefore, the guide blade may treat the garments having various sizes and shapes, thereby performing the intended accurate vertical folding process. For example, when the vertical folding process is intended to fold the garment having a large width into a small width, the guide blade may be moved inward to implement the desired vertical folding process without particular hindrance.

The vertical folding layer may have a conveyance guide unit 222. In the embodiment illustrated in FIG. 4, the conveyance guide unit 222 may be provided on the conveyor 20 of the second folding layer 220. Therefore, it is possible to prevent the separation of the garment C dropped from the upper conveyor 20 and suitably convey the garment C to the lower conveyor 20. Of course, the conveyance guide unit 222 may be provided so as not to deviate from the range of the frame in order to prevent unnecessary expansion of the workspace.

In addition, as described above, the vertical folding layer may include the vertical folding assembly 400. The vertical folding assembly 400 means an active vertical folding assembly that may be changed in position by the drive motor so that the garment deployed on the conveyor 20 is vertically folded. The structure and function of the vertical folding assembly 400 will be described in detail.

In some instances, the vertical folding layer may immediately convey the garment to the lower folding layer without performing the vertical folding process. Specifically, the garment loaded to the second folding layer 220 may be conveyed forward by the conveyor 20 and loaded to the third folding layer 230 disposed below the second folding layer 220 without being vertically folded by the vertical folding assembly 400. As described above, the vertical folding process, which conforms to the garments having various sizes and shapes, may be implemented.

Figure 6:
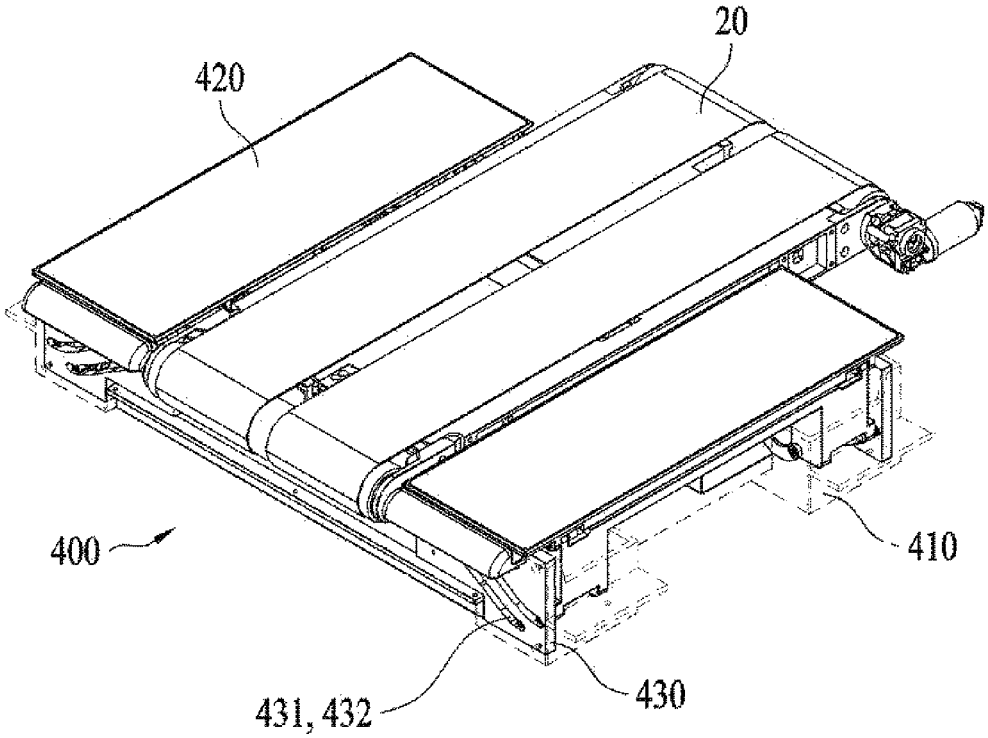
FIG. 6 is a perspective view illustrating an overall appearance of a vertical folding assembly according to the embodiment.
Figure 7:
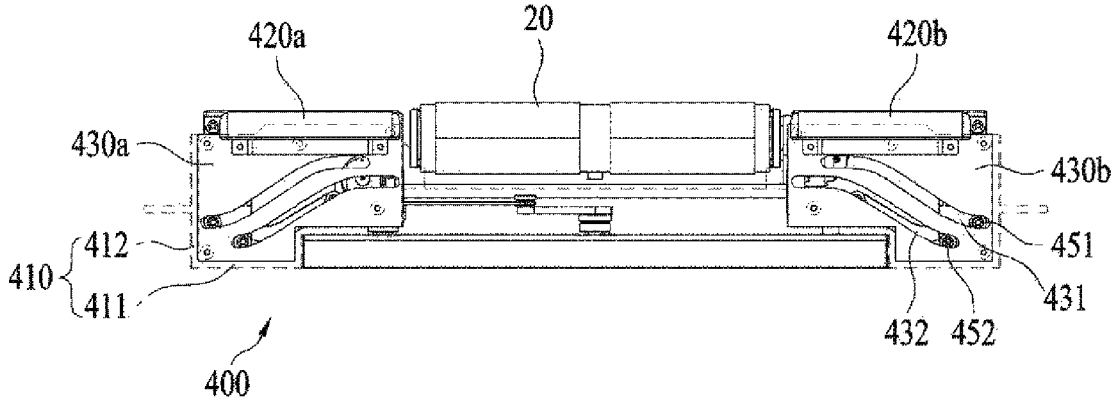
FIG. 7 is a front view of the vertical folding assembly according to the embodiment.
Figure 8:
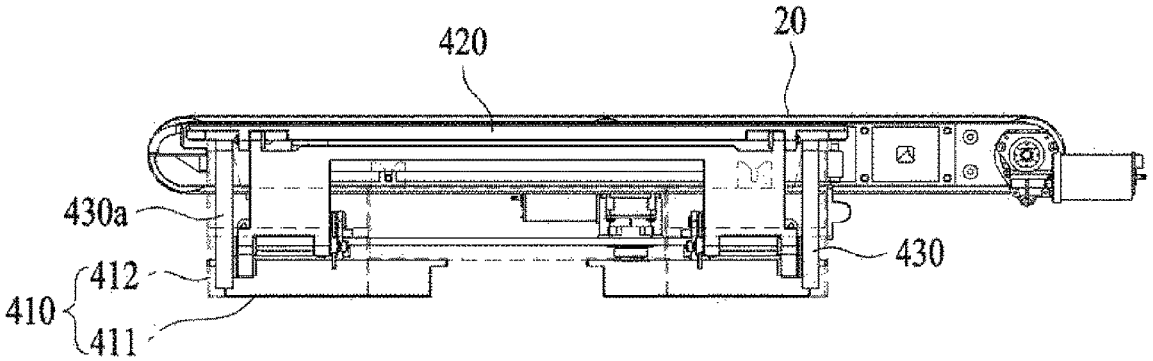
FIG. 8 is a side view of the vertical folding assembly according to the embodiment.
Figure 9:
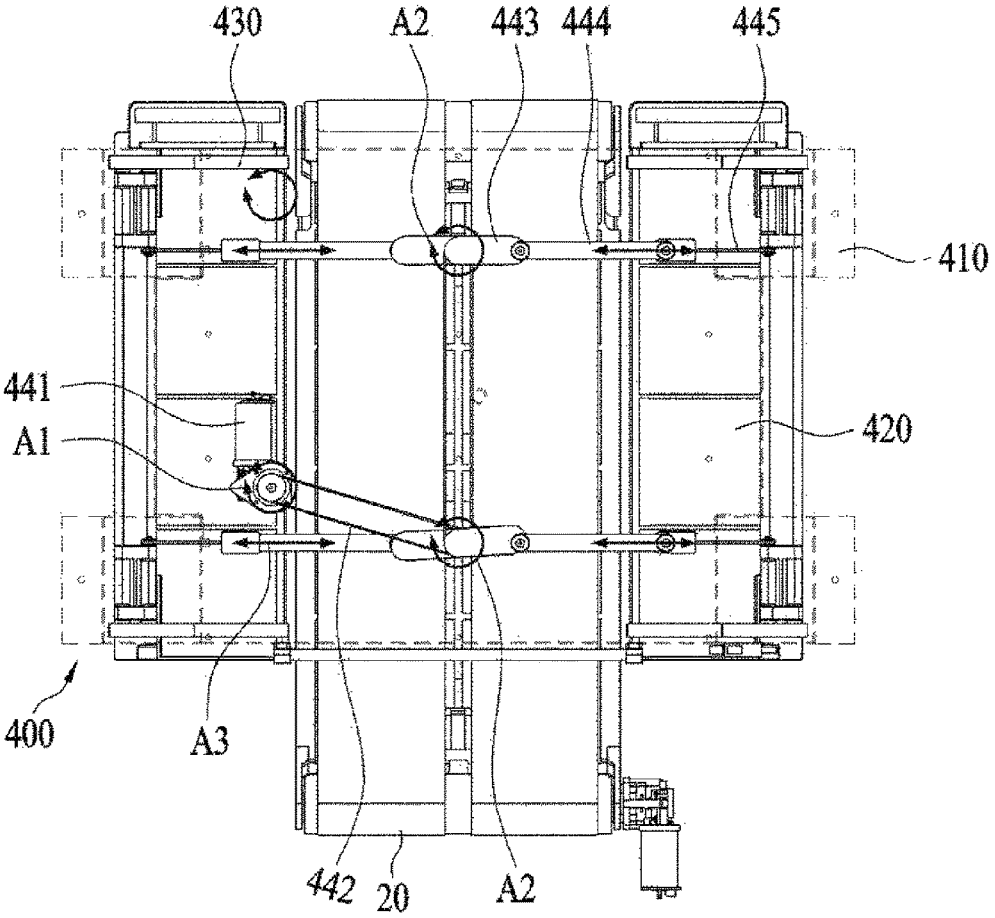
FIG. 9 is a bottom plan view of the vertical folding assembly according to the embodiment.
Figure 10:
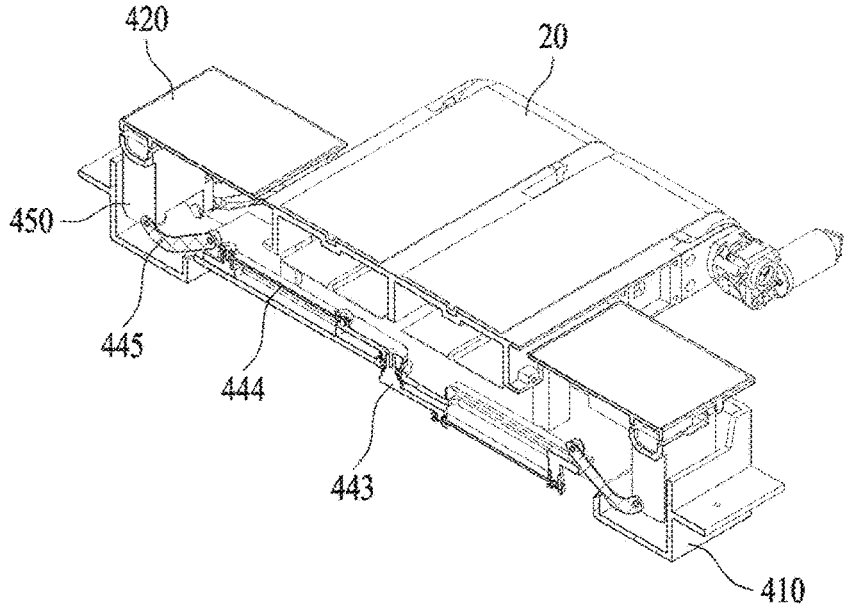
FIG. 10 is a cross-sectional perspective view of the vertical folding assembly according to the embodiment.
Figure 11:
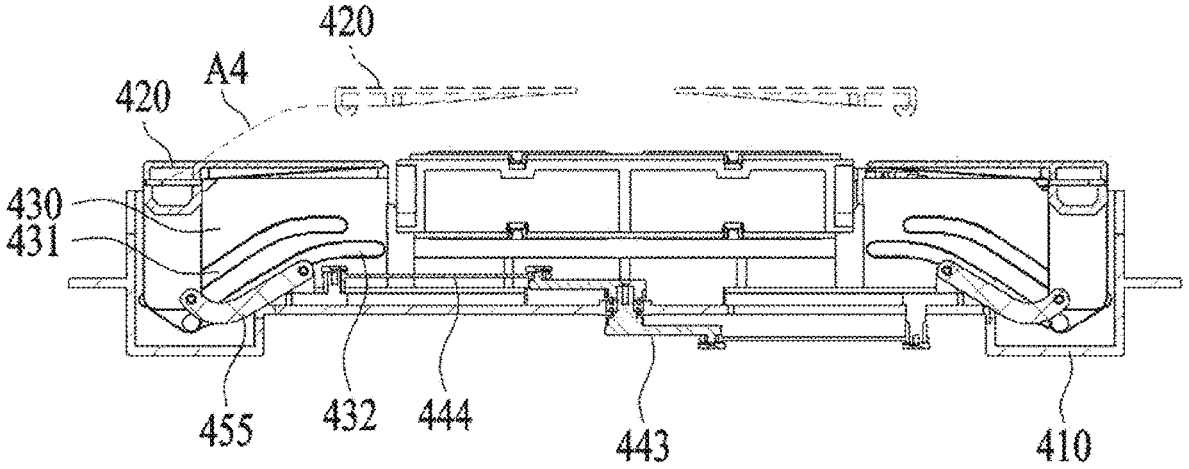
FIG. 11 is a view for explaining an operation of the vertical folding assembly according to the embodiment.
Figure 12:
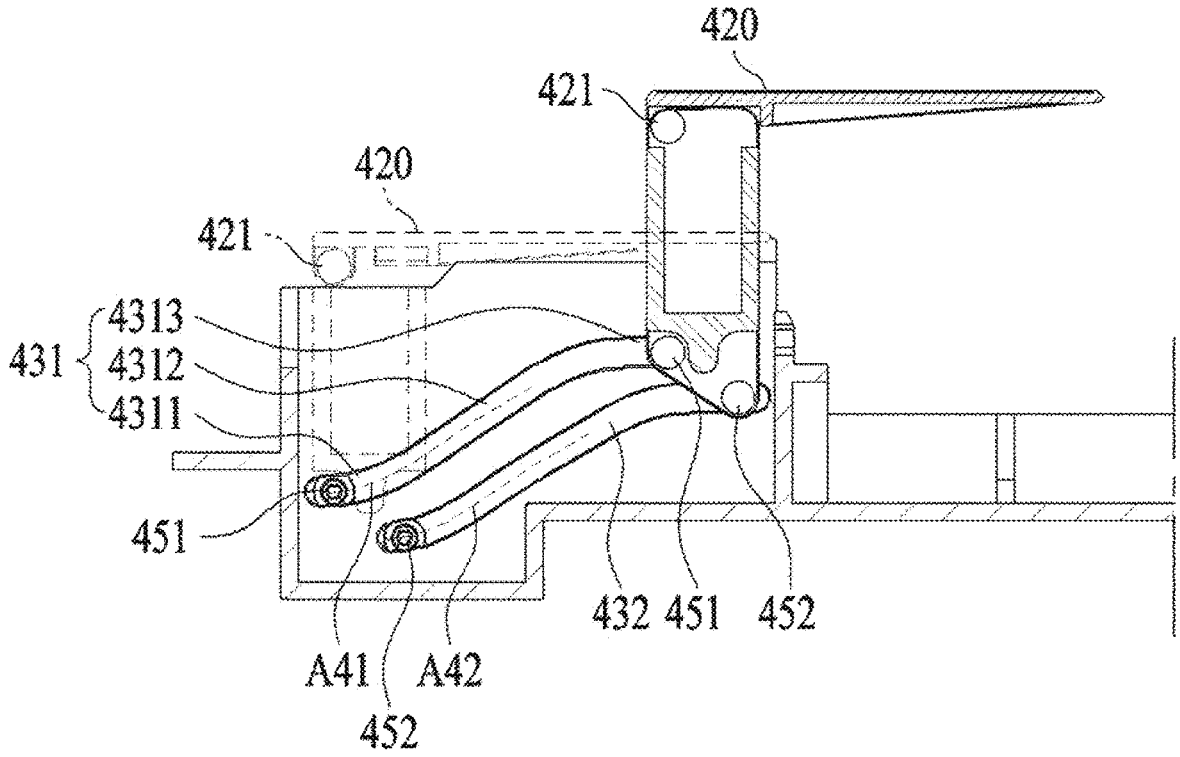
FIG. 12 is an enlarged view of a part of FIG. 11 for explaining the operation.

FIG. 6 is a perspective view illustrating an overall appearance of the vertical folding assembly according to the embodiment, FIG. 7 is a front view of the vertical folding assembly, FIG. 8 is a side view of the vertical folding assembly, FIG. 9 is a bottom plan view of the vertical folding assembly, FIG. 10 is a cross-sectional perspective view of the vertical folding assembly, FIG. 11 is a view for explaining an operation of the vertical folding assembly, and FIG. 12 is an enlarged view of a part of FIG. 11 for explaining the operation.

Referring to these drawings, the vertical folding assembly 400 may include a lower casing 410, plates 420, cam units 430, and a bottom structure 440.

The lower casing 410 (see the dotted line in FIG. 6) may surround a lower portion of the vertical folding assembly 400 and accommodate the bottom structure 440. Referring to FIGS. 7 and 8, the lower casing 410 may include a bottom portion 411 and a lateral portion 412. The bottom portion 411 may be configured such that the bottom structure 440 to be described below is mounted on the bottom portion 411. In addition, the lateral portion 412 protrudes upward from an edge of the bottom portion 411, such that the cam unit 430 to be described below may be mounted on the lateral portion 412.

The bottom portion 411 and the lateral portion 412 define a lower external appearance of the vertical folding assembly 400 and serve to protect the components, which are used to implement the folding operation of the vertical folding assembly 400, from external impact or the like.

In addition, the lateral portion 412 may have a horizontal protruding piece formed at an outer side thereof so that the lateral portion 412 may be supported on the horizontal frame. Therefore, the vertical folding assembly 400 may be fixed to the frame and stably operate.

The plates 420 may operate inward to fold the two opposite outer portions of the garment C placed on the conveyor 20.

Specifically, two plates 420*a* and 420*b* may be provided side by side and positioned at the left and right sides based on the conveyor 20 (see FIG. 7). The plates 420*a* and 420*b* may each have a rectangular shape. The plates 420*a* and 420*b* may each be formed to be shorter than the conveyor 20 in a longitudinal direction of the conveyor 20. Therefore, the garment C may be stably loaded onto the conveyor 20 and stably conveyed by the conveyor 20, such that the portions of the garment C, which are to be folded, may be accurately placed on the plates 420.

In addition, in a case in which the garment C is longer than the vertical folding assembly 400, the plates 420 of the vertical folding assembly 400 may operate multiple times. In this case, the size and shape of the plate 420 enable the continuous folding operation to be stably performed without a bottleneck situation.

Before the vertical folding process, the plates 420*a* and 420*b* may be disposed side by side at the left and right sides of the conveyor 20. In this case, the two plates 420*a* and 420*b* may be disposed symmetrically with respect to the conveyor 20. After the vertical folding process, the plates 420*a* and 420*b* may be disposed side by side at an inner upper side based on the conveyor 20. In this case, the two plates 420*a* and 420*b* may also be disposed symmetrically.

Specifically, before the vertical folding process, upper surfaces of the plates 420*a* and 420*b* may be disposed to be lower than an upper surface of the conveyor 20 (see FIG. 7). Therefore, a force applied by the conveyor 20 to convey the garment may be smoothly transmitted. That is, before the folding process, the plates 420 may be disposed so as not to interfere with the garment being loaded and conveyed.

The cam unit 430 may serve to allow the plates 420 to slide to the inner upper side of the conveyor 20. Since the cam unit 430 is provided, the plate 420 may slide along a rectilinear trajectory instead of a circular or curved trajectory.

Specifically, the cam unit 430 may include a guide groove, and an insertion part 450 (see FIG. 10) configured to slide along the guide groove. The plate 420 is provided on an upper portion of the insertion part 450, such that the plate 420 may move along the same trajectory as the insertion part 450. As a result, the trajectory of the plate 420 may be determined depending on the direction and shape of the guide groove.

The guide groove of the cam unit 430 may be formed straight. Specifically, the guide groove may be formed straight and inclined upward in a direction from the outside to the inside. Therefore, the plate 420 may slide toward the inner upper side along the rectilinear trajectory (see the dotted line A4 in FIG. 11).

The cam units 430 may be provided at the left and right sides and disposed symmetrically with respect to the conveyor 20. In addition, the guide grooves of the cam units 430 may be formed symmetrically with respect to the conveyor 20. That is, the guide groove of the left cam unit 430*a* may be inclined upward in a rightward direction, and the guide groove of the right cam unit 430*b* may be inclined upward in a leftward direction. Therefore, the two plates 420*a* and 420*b* may slide along the rectilinear trajectories toward the inner upper side at which the conveyor 20 is positioned.

Referring to FIGS. 11 to 12, the cam units 430 may each have two guide grooves 431 and 432 formed side by side. In this case, the configuration in which the two guide grooves are disposed side by side does not necessarily mean that the two guide grooves need to be parallel to each other. A structure in which the two guide grooves are disposed to be spaced apart from each other at a predetermined distance may also be applied. Therefore, the plate 420 may more accurately and stably slide along the rectilinear trajectory. In addition, the folding operation of skillfully and stably folding the corresponding portion of the garment vertically may be implemented while eliminating an unnecessary operation space.

In particular, referring to FIG. 12, the first guide groove 431 may have a different slide shape from the second guide groove 432. In this case, the configuration in which the guide grooves 431 and 432 have different slide shapes includes all the structures, except for a case in which the shapes of the guide grooves 431 and 432 are coincident with each other when one guide groove moves onto the other guide groove in a parallel manner.

The insertion part 450 includes a first insertion piece 451 and a second insertion piece 452. The first insertion piece 451 is inserted into the first guide groove 431, and the second insertion piece 452 is inserted into the second guide groove 432. The insertion part 450 moves along the first and second guide grooves 431 and 432. The plate 420 may basically move along the rectilinear trajectory toward the inner upper side while being lifted without colliding with a peripheral member (e.g., an edge of the conveyor).

As described above, the structures of the first and second guide grooves 431 and 432 may allow the plate 420 to basically move along the rectilinear trajectory and also lift the plate 420 more accurately and stably while preventing the plate 420 from colliding with the peripheral member.

Specifically, according to the embodiment illustrated in FIG. 12, the first guide groove 431 may include a first horizontal groove 4311, an inclined groove 4312, and a second horizontal groove 4313 that are continuously connected. The first horizontal groove 4311 may be shorter than the second horizontal groove 4313. An initial horizontal trajectory A41 is defined by the first horizontal groove 4311, and then an inclined trajectory A42 is defined as the inclined groove 4312 is immediately connected to the first horizontal groove 4311. Lastly, the trajectory returns to a horizontal trajectory A43 defined by the second horizontal groove 4313. As the trajectory switches from the initial horizontal trajectory A41 to the inclined trajectory A42, an operation of lifting an inner end of the plate 420 may be performed. As the trajectory switches from the inclined trajectory A42 to the horizontal trajectory A43, an operation of stably stopping the plate 420 may be performed.

Likewise, the second guide groove 432 having a different slide shape from the first guide groove 431 may have a first horizontal groove, an inclined groove, and a second horizontal groove that are continuously connected. In this case, the first and second guide grooves 431 and 432 may be different from each other in sizes and angles of the first horizontal grooves, the inclined grooves, and the second horizontal grooves, such that the angular and rectilinear motions of the plate 420, which moves while being inserted into the two guide grooves 431 and 432, may be changed. In other words, the motion, such as an angular motion, of the plate, which is hardly implemented only by using a single guide groove, may be implemented by the slide shapes of the first and second guide grooves 431 and 432.

In addition, according to the embodiment illustrated in FIG. 12, a plate hinge 421 may be provided between the plate 420 and the insertion part 450, thereby providing flexibility to the sliding motion of the plate 420. The insertion part 450 is configured to move along the two guide grooves 431 and 432, and the plate 420 is hingedly coupled to the insertion part 450, such that flexibility is provided to a section in which the angular motion and the rectilinear motion are converted into each other. Therefore, it is possible to implement a more stable motion of the plate while preventing the plate from colliding with the peripheral member.

As described above, the operation of the plate 420 for performing the vertical folding process is implemented by the sliding motion made by the cam unit 430, such that the rectilinear trajectory is defined instead of a circular or curved trajectory. Therefore, the required operation space may be reduced, which may contribute to the miniaturization of the apparatus. Further, a uniform and accurate vertical folding process may be performed without being affected by the material and size of the garment.

Figure 13:
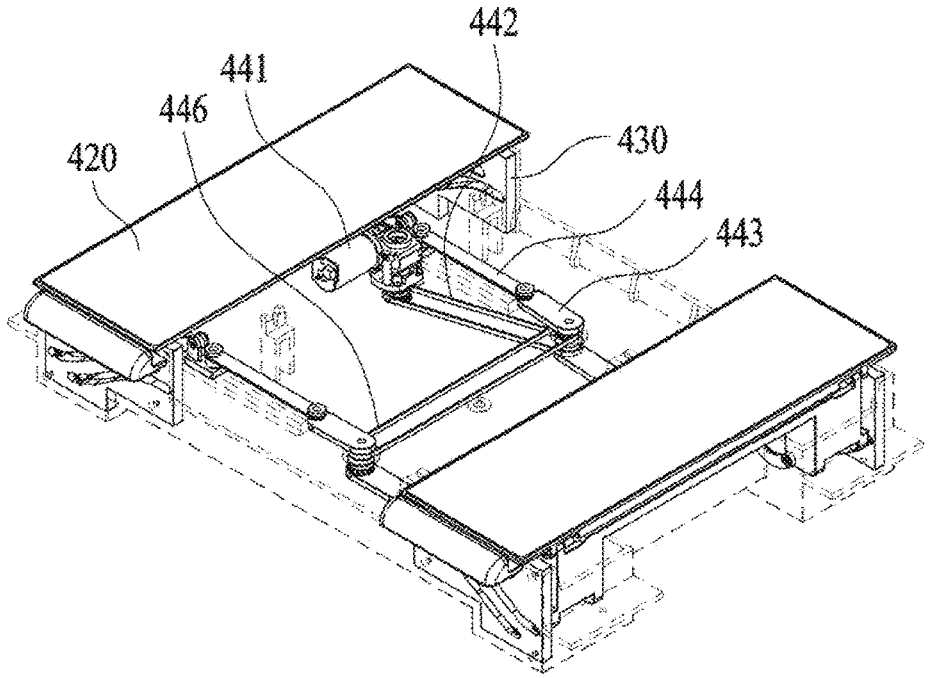
FIG. 13 is a perspective view illustrating a bottom structure of the vertical folding assembly according to the embodiment.
Figure 14:
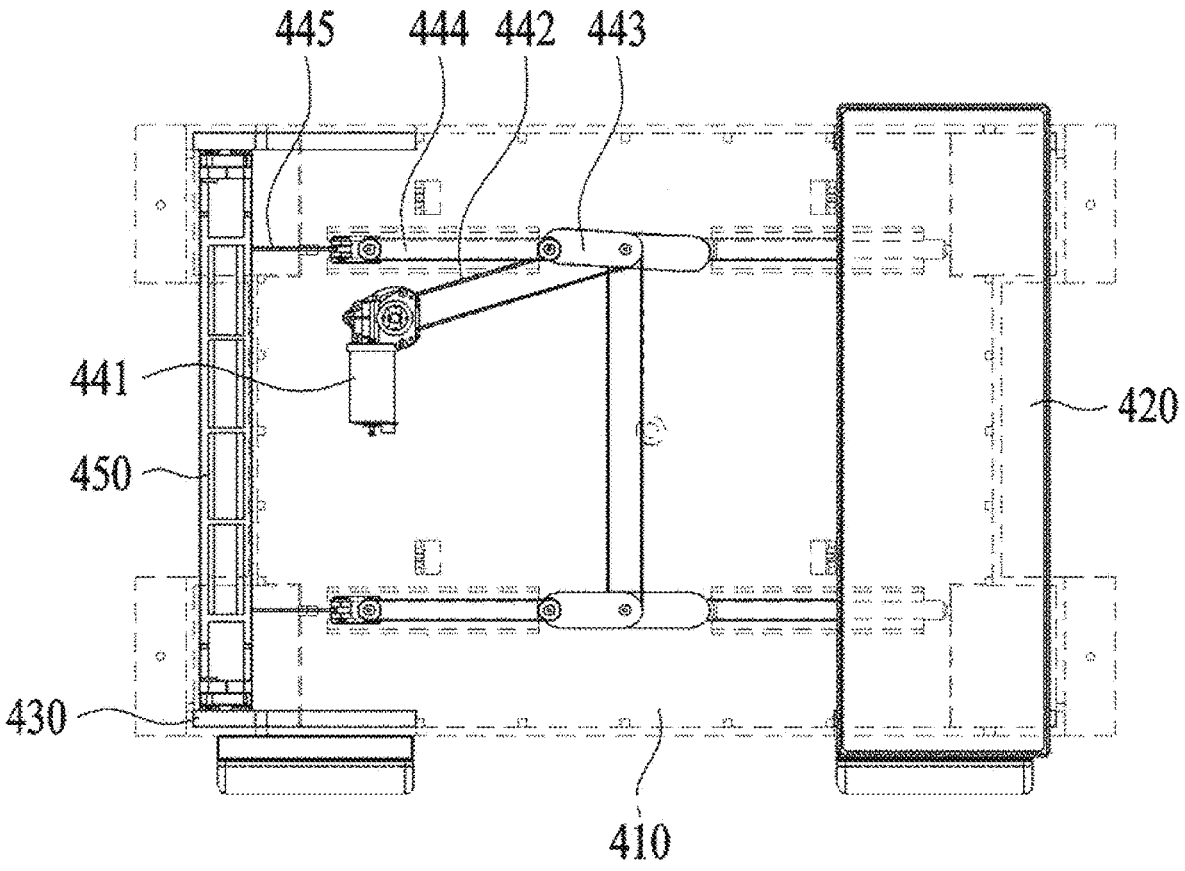
FIG. 14 is a top plan view illustrating the bottom structure of the vertical folding assembly according to the embodiment.

FIG. 13 is a perspective view illustrating a bottom structure of the vertical folding assembly according to the embodiment, and FIG. 14 is a top plan view of the vertical folding assembly.

The bottom structure 440 may be provided in the lower housing 410 to implement the above-mentioned motion of the plate 420. Since the bottom structure 440 is provided, the sliding motion of the plate 420, which follows the rectilinear trajectory by means of a comparatively small number of members and the structure with minimized mutual interference, may be implemented in the vertical folding assembly 400.

Referring to FIGS. 13 and 14, the bottom structure 440 includes: a drive motor 441 configured to provide a rotational force; a belt 442 configured to transmit the rotational force of the drive motor 441; a rotary link 443 configured to be rotated about a central axis by the belt 442; a connecting link 444 connected to one end of the rotary link 443 and configured to convert a rotational motion of the rotary link 443 into a rectilinear motion; and a slider 445 having one end connected to the connecting link 444 and the other end connected to the insertion part 450.

In this case, the drive motor 441 is not limited to a mechanical motor operated by an electromagnetic force. The drive motor 441 includes all active power sources, for example, means for generating a rotational force by using electricity as a power source, except for a manual power source directly produced by a user.

Further, the active vertical folding assembly or the actively operating vertical folding assembly means a vertical folding assembly operated by all power sources, for example, electricity, except for a manual power source directly produced by the user.

Referring to FIG. 9, a rotational motion A1 generated by the drive motor 441 of the bottom structure 440 is converted into a rotational motion A2 of the rotary link 443 by the belt 442. The rotational motion A2 is converted into a rectilinear motion A3 of the connecting link 444. The rectilinear motion A3 may implement a rectilinear trajectory A4 (see FIG. 11) of the plate 420 by means of the slider 445 and the insertion part 450.

Specifically, the rotary link 443 may be provided as two rotary links, and the two rotary links may be spaced apart from each other in an upward/downward direction based on the bottom portion 411 (see FIG. 10). In addition, the rotary links 443 may be disposed symmetrically with respect to the central axis. That is, the rotary link 443 disposed at the upper side of the bottom portion 411 and the rotary link 443 at the lower side of the bottom portion 411 may be disposed symmetrically with respect to the central axis. Therefore, the connecting link 444 and the slider 445 are connected to the upper and lower rotary links, and the insertion parts 450 are connected to left and right edges of the upper and lower rotary links, such that the two plates 420*a* and 420*b* slide symmetrically.

Since the two rotary links 443 are spaced apart from each other in the upward/downward direction and disposed symmetrically as described above, the sliding motions of the two plates 420*a* and 420*b* may be simultaneously performed. Therefore, the number of members for implementing the sliding motions of the two plates 420*a* and 420*b* is reduced, which simplifies the structure. The structures related to the upper rotary link and the structures related to the lower rotary link may be disposed so as not to interfere with one another.

Meanwhile, the rotary link 443 and the connecting link 444 may be hingedly coupled. The connecting link 444 and the slider 445 may be hingedly coupled. In this case, the structures for implementing the hinged coupling may be separately provided between the connecting link 444 and the slider 445. The slider 445 and the insertion part 450 may be hingedly coupled.

Therefore, the rotational force generated by the drive motor 441 may be stably transmitted to the sliding motion without loss. Further, the sliding motion of the plate 420 may be implemented within a limited internal space in the lower housing 410.

Figure 15:
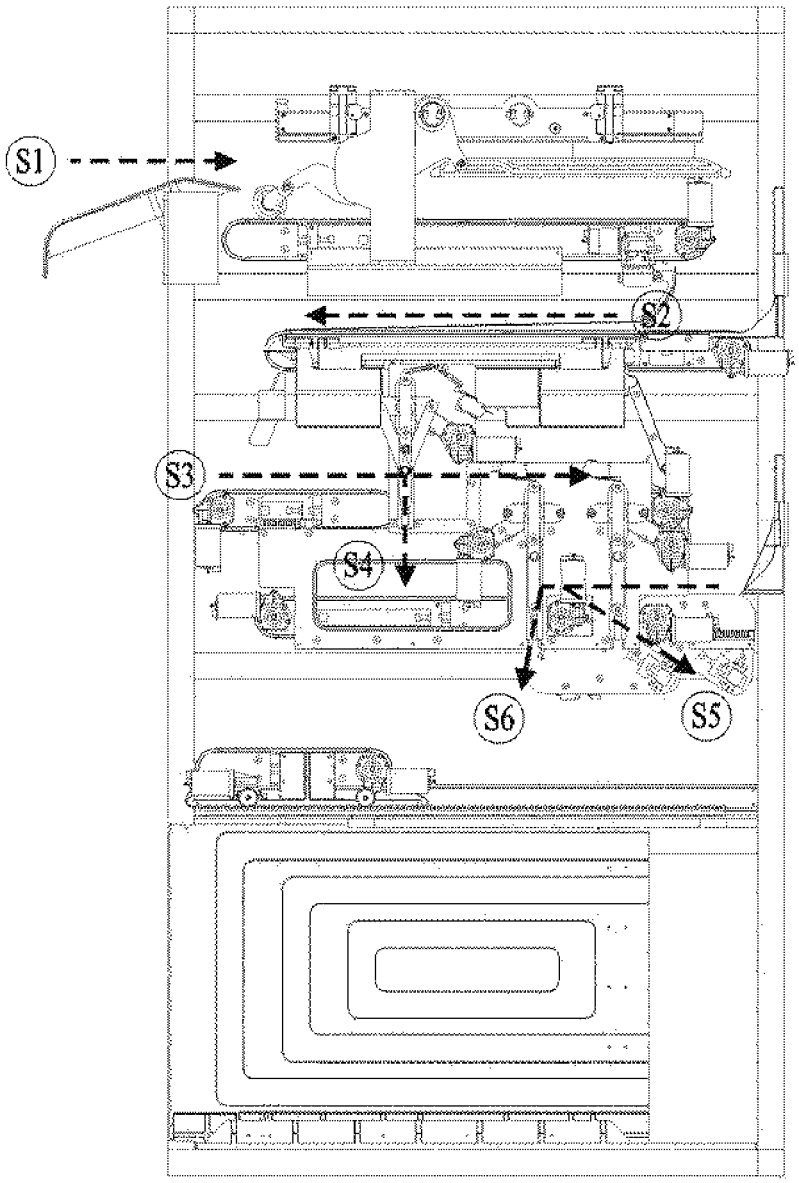
FIG. 15 is a conceptual view illustrating a garment folding method using the garment folding apparatus.
Figure 16:
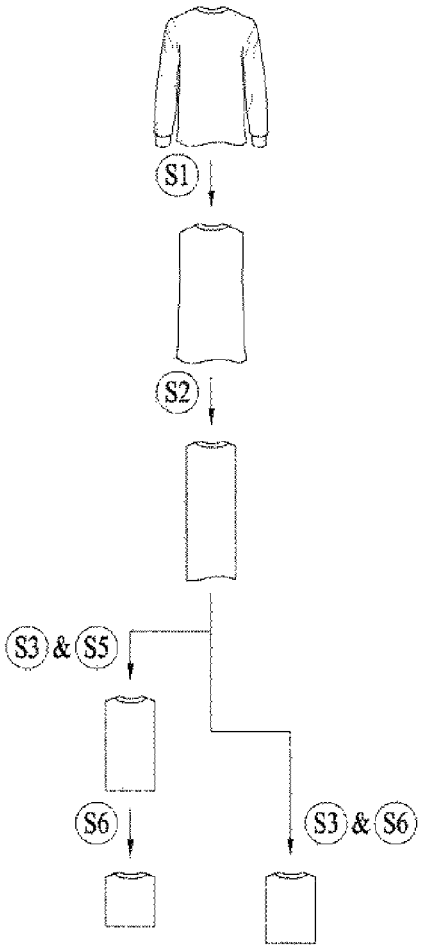
FIG. 16 is a flowchart illustrating one embodiment of the garment folding method.
Figure 17:
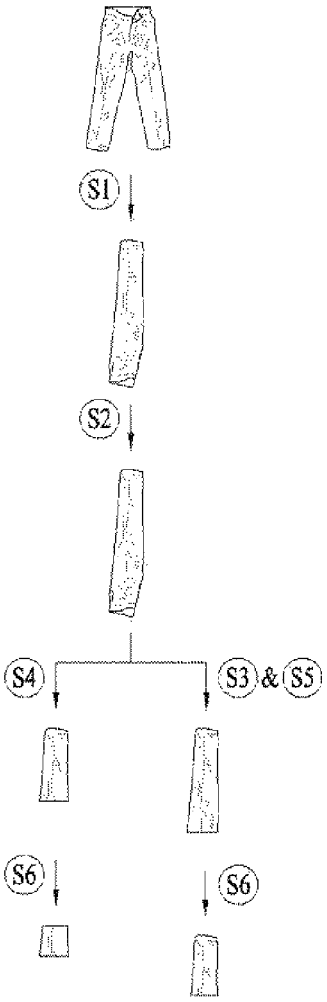
FIG. 17 is a flowchart illustrating another embodiment of the garment folding method.
Figure 18:
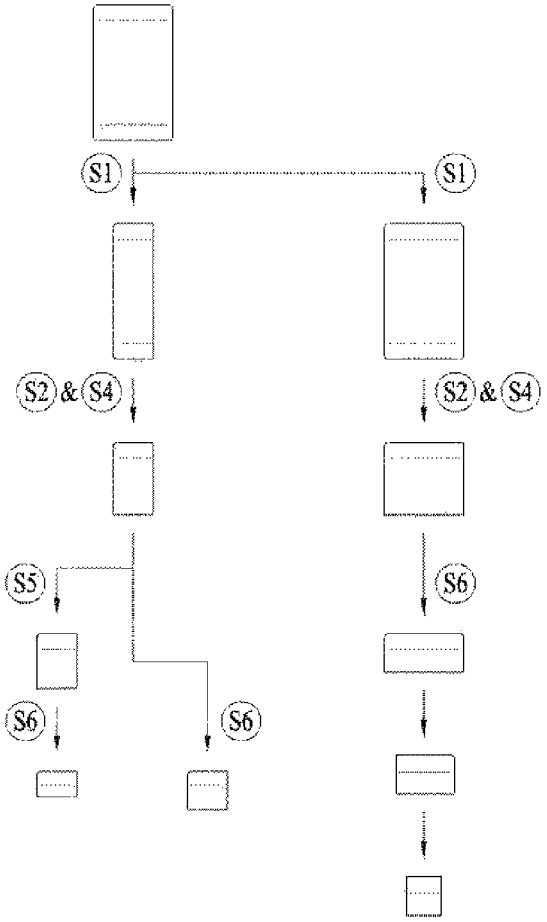
FIG. 18 is a flowchart illustrating still another embodiment of the garment folding method.

FIGS. 15 to 18 are views illustrating various garment folding methods using the garment folding apparatus according to the present disclosure, in which FIG. 15 is a conceptual view illustrating positions in the folding assembly at which the folding process is performed, FIG. 16 is a flowchart illustrating a garment folding method of folding upper garments as an embodiment, FIG. 17 is a flowchart illustrating a garment folding method of folding lower garments as an embodiment, and FIG. 18 is a flowchart illustrating a garment folding method of folding towels as an embodiment.

According to the embodiment of the folding assembly 200, the method of folding the garment loaded into the garment folding apparatus according to the present disclosure includes: a first vertical folding step S1 of folding the garment in the first folding layer 210; a second vertical folding step S2 of folding the garment in the second folding layer 220; a first horizontal folding step S3 and S4 of folding the garment in the third folding layer 230; and a second horizontal folding step S5 and S6 of folding the garment in the fourth folding layer 240.

The first horizontal folding step S3 and S4 includes a conveyance step S3 of conveying the garment to the lower folding layer without folding the garment, and a folding step S4.

The second horizontal folding step S5 and S6 includes a ⅓ folding step S5 of folding the garment at a ⅓ point based on the conveyance direction, and a ½ folding step S6 of folding the garment at a ½ point based on the conveyance direction.

In one embodiment, the vertical folding assembly 400 according to the present disclosure may serve to perform the second vertical folding step S2.

In the embodiment illustrated in FIG. 16, the upper garment loaded into the garment folding apparatus according to the present disclosure may be vertically folded in the first vertical folding step S1 and the second vertical folding step S2. Thereafter, the upper garment is horizontally folded. In this regard, two embodiments will be described.

According to the first embodiment, the vertically folded garment is conveyed immediately without being folded in the third horizontal folding step (S3), and then sequentially subjected to the ⅓ folding step S5 and the ½ folding step S6 in the fourth horizontal folding step, such that the upper garment, which is completely horizontally folded in three stages, may be unloaded (see the left flowchart in FIG. 16).

According to the second embodiment, the vertically folded garment is conveyed immediately without being folded in the third horizontal folding step (S3), and then subjected only to the ½ folding step S6 in the fourth horizontal folding step, such that the upper garment, which is completely horizontally folded in four stages, may be unloaded (see the right flowchart in FIG. 16).

In the embodiment illustrated in FIG. 17, the lower garment loaded into the garment folding apparatus according to the present disclosure may be vertically folded once while passing through the first vertical folding step S1 and the second vertical folding step S2. That is, in the second vertical folding step S2, the towel is immediately conveyed without being folded by the vertical folding assembly. Thereafter, the lower garment is horizontally folded. In this regard, two embodiments will be described.

According to the first embodiment, the vertically folded garment is horizontally folded in the third horizontal folding step S4 and then horizontally folded in the ½ folding step S6 in the fourth horizontal folding step, such that the lower garment, which is completely horizontally folded in four stages, may be unloaded (see the left flowchart in FIG. 17).

According to the second embodiment, the vertically folded garment is conveyed immediately without being folded in the third horizontal folding step S3 and then sequentially subjected to the ⅓ folding step S5 and the ½ folding step S6 ⅓ folding step S5 and the ½ folding step S6 in the fourth horizontal folding step, such that the lower garment, which is completely horizontally folded in three stages, may be unloaded (see the right flowchart in FIG. 17).

In the embodiment illustrated in FIG. 18, the towel loaded into the garment folding apparatus according to the present disclosure is subjected to the vertical and horizontal folding steps. In this regard, three embodiments will be described.

According to the first embodiment, the loaded towel may be vertically folded once while passing through the first vertical folding step S1 and the second vertical folding step S2. That is, in the second vertical folding step S2, the towel is immediately conveyed without being folded by the vertical folding assembly. Next, after the towel is horizontally folded in the third horizontal folding step S4, the towel is sequentially subjected to the ⅓ folding step S5 and the ½ folding step S6 in the fourth horizontal folding step, such that the towel having a hand towel size and shape for being stored in a bathroom cabinet may be unloaded (see the left flowchart in FIG. 18).

According to the second embodiment, the loaded towel may be vertically folded once while passing through the first vertical folding step S1 and the second vertical folding step S2. That is, in the second vertical folding step S2, the towel is immediately conveyed without being folded by the vertical folding assembly. Next, after the towel is horizontally folded in the third horizontal folding step S4, the towel is immediately subjected to the ½ folding step S6 in the fourth horizontal folding step, such that the towel may be unloaded as a hand towel different in size and shape from the hand towel according to the first embodiment (see the intermediate flowchart in FIG. 18).

According to the third embodiment, the loaded towel is conveyed immediately without being vertically folded while passing through the first vertical folding step S1 and the second vertical folding step S2. Thereafter, after the towel is horizontally folded in the third horizontal folding step S4, the towel is immediately subjected to the ½ folding step S6 in the fourth horizontal folding step, such that the towel different in size and shape from the hand towels according to the first and second embodiments may be unloaded (see the right flowchart in FIG. 18). As another embodiment, the vertical folding layer may be further provided below the fourth folding layer so that the vertical folding process is additionally performed after the horizontal folding process is completed. In this case, a hand towel having a smaller vertical width than the towel according to the third embodiment may be unloaded and appropriately stored in an intended bathroom cabinet.

It is apparent to those skilled in the art that the present disclosure may be specified as other specific forms without departing from the spirit and the essential features of the present disclosure.

It should be appreciated that the detailed description is interpreted as being illustrative in every sense, not restrictive. The scope of the present disclosure should be determined based on the reasonable interpretation of the appended claims, and all of the modifications within the equivalent scope of the present disclosure belong to the scope of the present disclosure.

The invention claimed is:

1. A garment folding apparatus, which serves to fold a garment during a process of conveying the garment, the garment folding apparatus comprising:

a loading assembly configured to load the garment;

a folding assembly configured to fold the loaded garment while conveying the garment; and an unloading assembly disposed below the folding assembly and configured to unload a completely folded garment, wherein the folding assembly comprises a vertical folding assembly configured to actively fold the garment deployed on a conveyor by using a drive motor, and wherein the vertical folding assembly comprises:

plates disposed side by side on the conveyor and configured to move to an inner upper side of the conveyor during a folding operation; and cam units having guide grooves so that the plates slide along rectilinear trajectories when the plates operate.

2. The garment folding apparatus of claim 1, wherein insertion parts connected to the plates are inserted into the guide grooves so that the plates move along the rectilinear trajectories defined by the guide grooves.

3. The garment folding apparatus of claim 2, wherein the guide grooves are inclined toward the inner upper side from an outside of the folding assembly.

4. The garment folding apparatus of claim 3, wherein each of the cam units has the guide grooves comprising first and second guide grooves formed side by side.

5. The garment folding apparatus of claim 4, wherein the first and second guide grooves have different slide shapes.

6. The garment folding apparatus of claim 3, wherein the guide grooves comprise:

a horizontal groove configured to allow the plates to initially operate along a horizontal trajectory; and an inclined groove connected to the horizontal groove and configured to allow the plates to have an inclined trajectory.

7. The garment folding apparatus of claim 2, wherein a plate hinge is provided between one of the plates and one of the insertion parts.

8. The garment folding apparatus of claim 2, wherein the vertical folding assembly comprises:

a lower housing configured to accommodate the cam units; and a bottom structure provided in the lower housing and configured to implement a motion of the plates.

9. The garment folding apparatus of claim 8, wherein the bottom structure comprises:

rotary links configured to receive a rotational force from the drive motor and rotate about a central axis; and a connecting link configured to convert a rotational motion of the rotary links into a rectilinear motion.

10. The garment folding apparatus of claim 9, wherein the rotary links are spaced apart from each other in an upward/downward direction and disposed symmetrically with respect to the lower housing.

11. The garment folding apparatus of claim 9, wherein the bottom structure further comprises a slider having one end connected to the connecting link and the other end connected to the insertion parts.

12. The garment folding apparatus of claim 11, wherein the rotary links, the connecting link, and the slider are hingedly coupled to one another.

* * * * *